United States Patent [19]

Chen

[11] Patent Number: 5,021,706

[45] Date of Patent: Jun. 4, 1991

[54] MODIFIED X'MAS LAMP STRUCTURE AND ITS RELATED LAMP BASE

[76] Inventor: Ming-Hsiung Chen, 7F, 16, Alley 3, Lane 227, Nung-An St., Taipei, Taiwan

[21] Appl. No.: 299,766

[22] Filed: Jan. 23, 1989

[51] Int. Cl.[5] ..... H01J 5/56; H01J 5/60

[52] U.S. Cl. ..... 313/318; 313/49; 313/51; 362/226; 362/432; 362/806

[58] Field of Search ..... 313/318, 49, 51; 362/226, 806, 441, 432, 396; 439/611

[56] References Cited

U.S. PATENT DOCUMENTS

| | | | |
|---|---|---|---|
| 2,268,700 | 1/1942 | Criger et al. | 313/318 |
| 3,529,202 | 9/1970 | Taormina | 313/318 |
| 3,749,960 | 7/1973 | Fuqua et al. | 313/318 |
| 3,861,632 | 1/1975 | Siilats | 362/432 X |
| 4,100,448 | 7/1978 | Chipner et al. | 313/318 |

*Primary Examiner*—Donald J. Yusko
*Assistant Examiner*—Michael Horabik
*Attorney, Agent, or Firm*—Ladas & Parry

[57] ABSTRACT

A modified X'mas lamp bulb and the related lamp base, and more particularly a big lamp bulb of low voltage to match a water-tight lamp base structure by means of set-in connection so as to let the whole lamp assembly be matchable with any lamp holder (socket) of small X'mas light sets through series connection. The component parts can be manufactured through mass production to reduce manufacturing cost. In addition to the water-proof feature, a clamping and a fastening member are provided to let the whole assembly be convenient for hanging on or fixing to any position desired.

2 Claims, 3 Drawing Sheets

MODIFIED X'MAS LAMP STRUCTURE AND ITS RELATED LAMP BASE

BACKGROUND OF THE INVENTION

This invention relates to a X'mas lamp structure and its related lamp base, and more particularly to the big X'mas lamps applicable for series connection.

In Western countries, X'mas lamps are commonly used by the people to decorate houses, buildings and X'mas trees for X'mas.

Regular big X'mas lamps for 120V or 240V (5 Watts, 7 Watt or higher voltage consumption bulbs) are commonly comprised of a copper lamp base for connection with a respective lamp holder (socket) so as to further let a plurality of lamps be connected in parallel with one another for application and decoration. In this arrangement, the big conventional X'mas lamps provide following inconveniences and drawbacks: (1) Parallel connection of lamps allows the the connected lamps to be turned on concomitantly or to be turned to flash simultaneously, but prohibits alternative flashing as provided in series connection of lamps.

(2) The paralleled lamps for 120V or 240V requires high consumption of power.

(3) The lamps for 120V or 240V produce high temperature during operation, to increase the risk of fire due to improper allocation or handling.

SUMMARY OF THE INVENTION

The present invention is related to a kind of X'mas lamp and its related lamp base and, more particularly to a modified lamp base structure for big lamps so as to let big lamps be applicable to match same with a socket for small lamp bulbs for series connection to provide variable flash motion. According to the present invention, it improves the limitation of parallel connection in regular big lamps for copper lamp base, and it provides water-proof property, of which the structure is inexpensive to manufacture and is easy for assembly.

The main object of the present invention is to provide a low voltage, heat-free lamp bulb (9V or 12V, . . . ) and its related lamp base made of plastic material to provide water-proof property, so as to let a plurality of lamps be applicable for series connection.

Further ojects, features and other aspects of this invention will be understood from the following description of the preferred embodiment of this invention referring to the annexed drawings.

DETAILED DESCRIPTION OF THE PREFERRED EMBODIMENT

Figure 1:
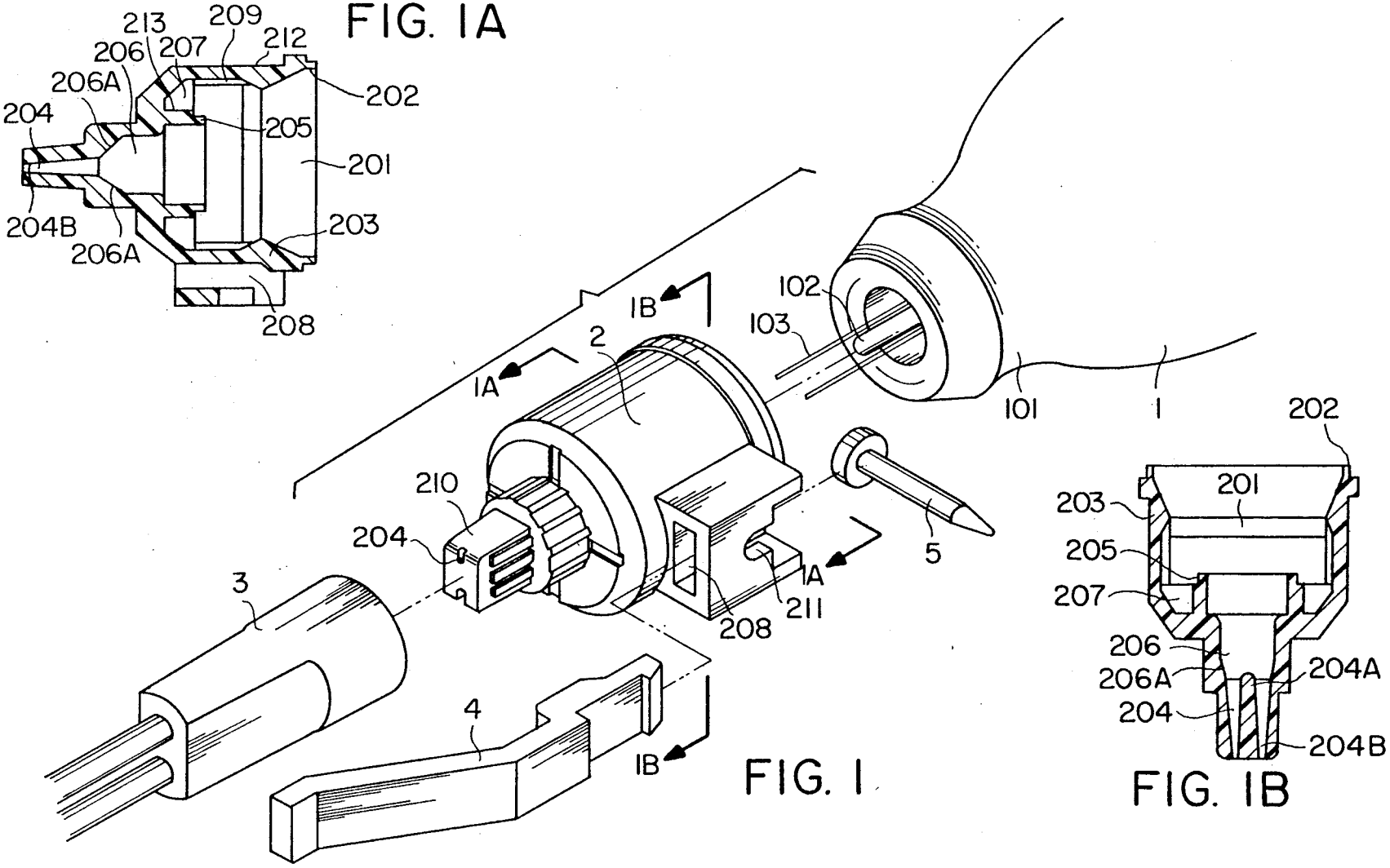
FIG. 1 is a perspective exploded view drawing of the present invention.
Figure 2:
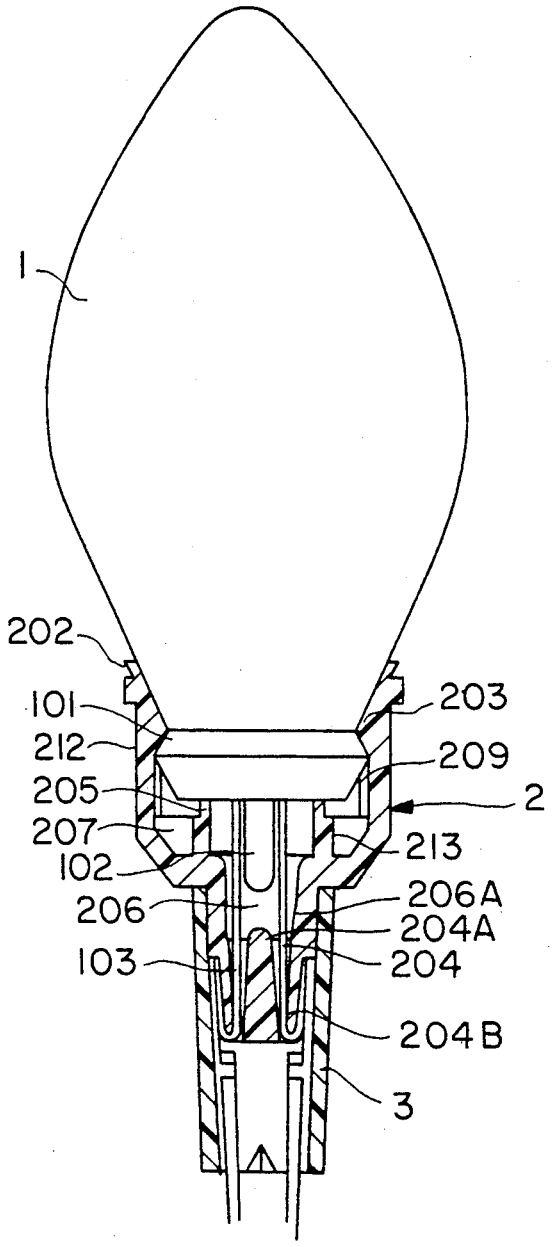
FIG. 2 is a longitudinal sectional view of the present invention.

Referring to FIG. 1 through 2, an embodiment of the present invention includes a lamp bulb (1), a lamp base (2), lamp holder (socket) (3), a bracket (4), and a nail (5). Said lamp base (2) is mainly made of resilient and fireproof material and has a housing for the receipt of a lamp bulb. As soon as said lamp bulb (1) is set in the connecting slot (201) of said lamp base (2), said lamp bulb (1) is tightly coupled with the resilient upper flange (202) located near the top of outer wall (212) to prevent permeation of rain water into said lamp base (2). Said connection slot (201) comprises an conically circular flange (203) located on the inside of the outer wall (212) to retain the circularly concave neck portion (101) of said lamp bulb (1) to prevent said lamp bulb (1) from breaking away from said lamp base (2). Said inner circular flange (203) has a resilient property to let said lamp bulb (1) be easily set in said lamp base (2) so as to tightly engage with said circularly concave neck portion (101) to provide a secondary water-proof mechanism. By means of said water-tight arrangement, no water is allowed to penetrate through the two small power line inlet holes (204-B) of said lamp base (2). Further, said lamp base (2) includes a connecting member (210) at the rear and for insertion into said socket (3).

Referring to FIG. 2 again, said connecting slot (201) of said lamp base (2) also comprises a stop member (207) at the bottom to let the distance from said stop member (207) to said inner circular flange (203) be slightly shorter than the total length from said circularly concave neck portion (101) of said lamp bulb (1) to the extreme bottom end of said lamp bulb (1). Therefore, when said lamp bulb (1) is set in said slot (201) of said lamp base (2), said lamp bulb (1) is upward squeezed by said stop member (207) and downward squeezed by said inner flange (203) to let said circularly concave neck portion (101) of said lamp bulb (1) be tightly retained therebetween, and to let said lamp bulb (1) be tightly held in said lamp base (2) against revolving force.

Said connecting slot (201) of said lamp base (2) also includes an inner wall (213) a water-proof ring bumper (205) which forms an inner wall having a soft and resilient ring portion at the top to slightly protrude beyond said stop member (207), such that when said lamp bulb (1) is set in said connecting slot (201) of said lamp base (2), said soft and resilient ring portion of said ring bumper (205) of said connecting slot (201) of said lamp base (2) is tightly stopped at the bottom surface of said base portion lamp bulb (1). The inner wall spaced from but connected to the outer wall (212), and a cavity is formed therebetween. Therefore, even if rain water permeates into said connecting slot (201) from the top, the water will be retained at the cavity between the outer wall (212) of said lamp base (2) and said water-proof ring bumper (205) which forms an inner wall and will not cause any short-circuit of the two copper wires (103) of said lamp bulb (1). There is also provided a cylindrical slot (206) below said water-proof ring bumper (205) for receiving the cylindrical end (102) of said lamp bulb (1) to let said cylindrical end (102) be protected thereinside. Said power line inlet holes (204) of said lamp base (2) have respectively a conical shape. The partition wall (204-A) between said two power line inlet holes (204) is arranged to insert into said cylindrical slot (206). There are also provided four inner wall slopes (206-A) on said cylindrical slot (206) respectively in contact with said power line inlet holes (204) to facilitate the insertion of the two power wires (103) of said lamp bulb (1) so as to let said copper wires (103) protrude beyond the small conical holes (204-B) for further connection to said socket (3).

Figure 3:
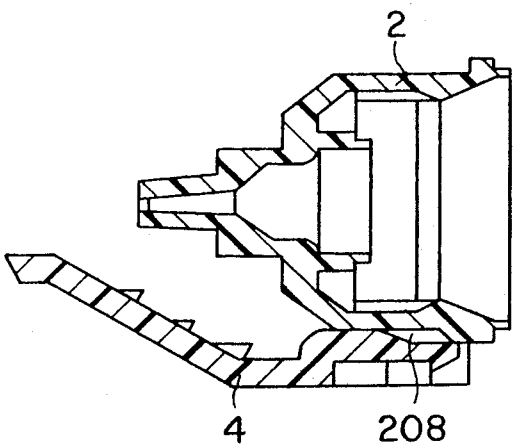
FIG. 3 is a schematic drawing of the invention, illustrating the connection of the bracket with the lamp base.

Referring to FIG. 3, said bracket (4) is mounted on the indentation (208) of said lamp base (2), it is arranged to match with said socket (3) to form a clamping means for hanging of the whole assembly on X'mas tree etc., with the lamp bulb (1) upward disposed or clamp for any direction preferred.

Figure 4:
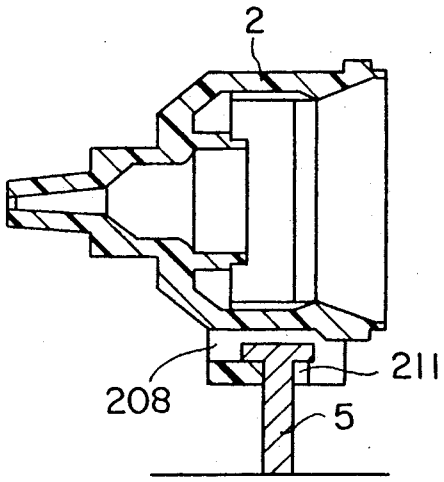
FIG. 4 is a schematic drawing of the invention, illustrating the fixation of the nail on the lamp base.

Referring to FIG. 4, a nail (5) in regular size is provided to match with said lamp base (2) for fixation of the whole assembly to any position desired letting the nail head of said nail (5) be held in the slot (211) of said indentation (208).

I claim:

1. A X'mas lamp and its related lamp base, including:

a lamp bulb comprising a top and bottom with a circular concave portion near its bottom and a cylindrical end at its bottom;

a lamp base made of fire-proof and resilient material, comprising a connecting slot at one end, said connecting slot having a conically circular flange on the inner wall to retain said circularly concave portion of said lamp bulb, a stop member at the bottom of said connecting slot to let the distance from said stop member to said conically circular flange be slightly longer than the total length from said circularly concave portion of said lamp bulb to the extreme bottom end of said lamp bulb, a waterproof ring bumper located adjacent to the stop member, having a soft and resilient ring portion at the top to slightly protrude beyond said stop member, a cylindrical slot located below said waterproof ring bumper for receiving the cylindrical end of said lamp bulb, two power line inlet holes defined in a connecting chamber at the end of lamp base opposite end which receives said lamp bulb arranged in a conical shape, a partition wall between said two power line inlet holes arranged for insertion into said cylindrical slot;

a socket, for connecting with the connecting member of said lamp base;

a bracket for mounting on an indentation of said lamp base to match with said socket to form a clamping means, said indentation having a slot;

a nail provided to match with said lamp base for fixation of the whole assembly with its nail head held in said slot of said indentation of said lamp base;

said lamp and its related lamp base forming a waterproof lamp assembly for hanging by means of said bracket with said lamp bulb upwardly disposed and for fixation to any place with said lamp bulb downwardly disposed.

2. A lamp bulb base for water-tight receipt of a lamp bulb, said lamp bulb having an upper portion, a neck portion below and connected to said upper portion, a base portion connected to said neck and below said upper portion and having a flat bottom forming one closed end of the lamp bulb, and power means electrically coupled to said base, said lamp bulb base comprising: a housing for receipt of said bulb, said housing comprising, (a) an outer wall which receives and lies adjacent to the vicinity of the neck of said lamp bulb when received, said outer wall having an indentation defined therethrough, said indentation itself defining a slot to receive a nail head for fixation of the lamp bulb base with the nail head held in said slot of said indentation, and (b) an inner wall spaced from said outer wall and forming a cavity therebetween, said inner wall being connected to but lying within said outer wall by a joining portion, said inner wall extending to abut the base portion of said lamp bulb, said lamp bulb base water-tightly receiving the lamp bulb by means of the interrelationship of said neck portion of said lamp bulb and said outer wall; and a bracket having one portion which snaps into said indentation and another portion which extends outside of said indentation, whereby said bracket can be used to attach the lamp bulb base to another object.

* * * * *